US007699301B2

(12) United States Patent
Caron

(10) Patent No.: US 7,699,301 B2
(45) Date of Patent: Apr. 20, 2010

(54) PRINTED PRODUCT PROCESSING DEVICE WITH CAM LEVER INHIBIT MECHANISM AND CAM INHIBIT METHOD

(75) Inventor: Glen Roger Caron, Greenland, NH (US)

(73) Assignee: Goss International Americas, Inc, Durham, NH (US)

( * ) Notice: Subject to any disclaimer, the term of this patent is extended or adjusted under 35 U.S.C. 154(b) by 190 days.

(21) Appl. No.: 11/391,896

(22) Filed: Mar. 29, 2006

(65) Prior Publication Data

US 2007/0235916 A1 Oct. 11, 2007

(51) Int. Cl.
*B65H 7/00* (2006.01)

(52) U.S. Cl. ..... 270/52.21; 270/52.19; 270/52.2; 270/52.22

(58) Field of Classification Search ..... 270/52.19, 270/52.2, 52.21, 52.22; 74/567, 569
See application file for complete search history.

(56) References Cited

U.S. PATENT DOCUMENTS 3,272,022 A * 9/1966 Spinner ..... 74/53
3,897,695 A * 8/1975 Rostad ..... 74/516
3,953,018 A 4/1976 Maopolski ..... 270/55
5,456,128 A * 10/1995 Thunker ..... 74/53
6,837,491 B2 * 1/2005 Becker et al. ..... 271/204

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

A printed product processing device with an inhibit function for a movable component includes a rotating cam, a cam follower actuating the movable component, a cam follower lever supporting the cam follower, and an actuatable latch lever having a roller for rolling on the cam follower. Also provided is a printed product processing device with an inhibit function for a movable component including a rotating cam, a cam follower actuating the movable component, a cam follower lever supporting the cam follower and an actuatable latch lever, the latch lever having an a latch lever pivot point located within an arc path of the cam follower lever. A method for inhibiting a cam follower from following a cam is also provided.

21 Claims, 2 Drawing Sheets

PRINTED PRODUCT PROCESSING DEVICE WITH CAM LEVER INHIBIT MECHANISM AND CAM INHIBIT METHOD

BACKGROUND

The present invention relates generally to devices for processing printed products such as a hopper or folder cylinder having a cam follower inhibited from contacting a cam profile, and to a cam inhibit method.

U.S. Pat. No. 3,953,018, hereby incorporated by reference herein, discloses a feed station which can inhibit movement of a sucker member during normal operation. A cam follower follows a cam via spring loading. As a high of the cam engages the cam follower, the sucker member moves upward to engage a signature. As the high leaves the cam follower, the sucker moves downwardly. The inhibiting action of this downward motion is effected using a latch mechanism including a latch member securely fastened on a bracket. A cooperating latch member is pivotable and can engage the latch member secured to the bracket. This mating engagement can prevent the bracket member from moving downwardly and the sucker member as a result stays in an up position. An air cylinder can actuate the latch.

U.S. Pat. No. 6,082,724 is also hereby incorporated by reference herein as showing a collating apparatus with sheet material feeders.

Alternate to such a latch mechanism is an air cylinder moving the lifting cam follower lever off the cam at various times without the use of a latch, i.e. simple back and forth air cylinder control of the cam follower.

SUMMARY OF THE INVENTION

Since the actuation time of the air cylinder in prior art non-latch air cylinder devices does not change with machine speed, the cylinder must be actuated at different points depending on speed to remove and effect inhibition of the suckers. Many factors such as air pressure, orifice size, valve size, affect actuation time of the cylinder. The mechanism must be timed to exaction to prevent any unnecessary wear and tear on the cam follower mechanism.

While latch mechanisms reduce the need for precision when using an air cylinder, the cam follower in many latch mechanisms is not lifted higher than the high of the cam and during inhibition, the cam follower still strikes the cam every time a cam high passes the cam follower. Also, the latch has a metal to metal impact during actuation which makes designing a latch mechanism with a long lifespan difficult.

The present invention provides a printed product processing device with an inhibit function for a movable component comprising a rotating cam, a cam follower actuating the movable component, a cam follower lever supporting the cam follower and an actuatable latch lever having a roller for rolling on the cam follower.

By having a roller contact the cam follower lever, wear and other contact issues related to traditional latches can be reduced.

The present invention provides a printed product processing device with an inhibit function for a movable component comprising a rotating cam, a cam follower actuating the movable component, a cam follower lever supporting the cam follower and an actuatable latch lever, the latch lever having an a latch lever pivot point located within an arc path of the cam follower lever.

By having the latch lever have a pivot in such fashion, a geometry is possible which results in a simple inhibit mechanism with reduced wear and easy actuation.

The present invention also provides a method for inhibiting a cam follower from following a cam comprising the steps of: permitting a cam follower to follow a cam with at least one high dwell, moving the cam follower out of the path of the at least one high dwell by pushing up a cam follower lever of the cam follower using a roller, permitting the roller to rest against a latch of the cam follower roller, and rotating the cam so that the at least one high dwell contacts the roller and releases the roller from the latch.

BRIEF DESCRIPTION OF THE DRAWINGS

A preferred embodiment of the present invention will be elucidated with reference to the following drawings, in which.

DETAILED DESCRIPTION OF THE PREFERRED EMBODIMENT

Figure 1:
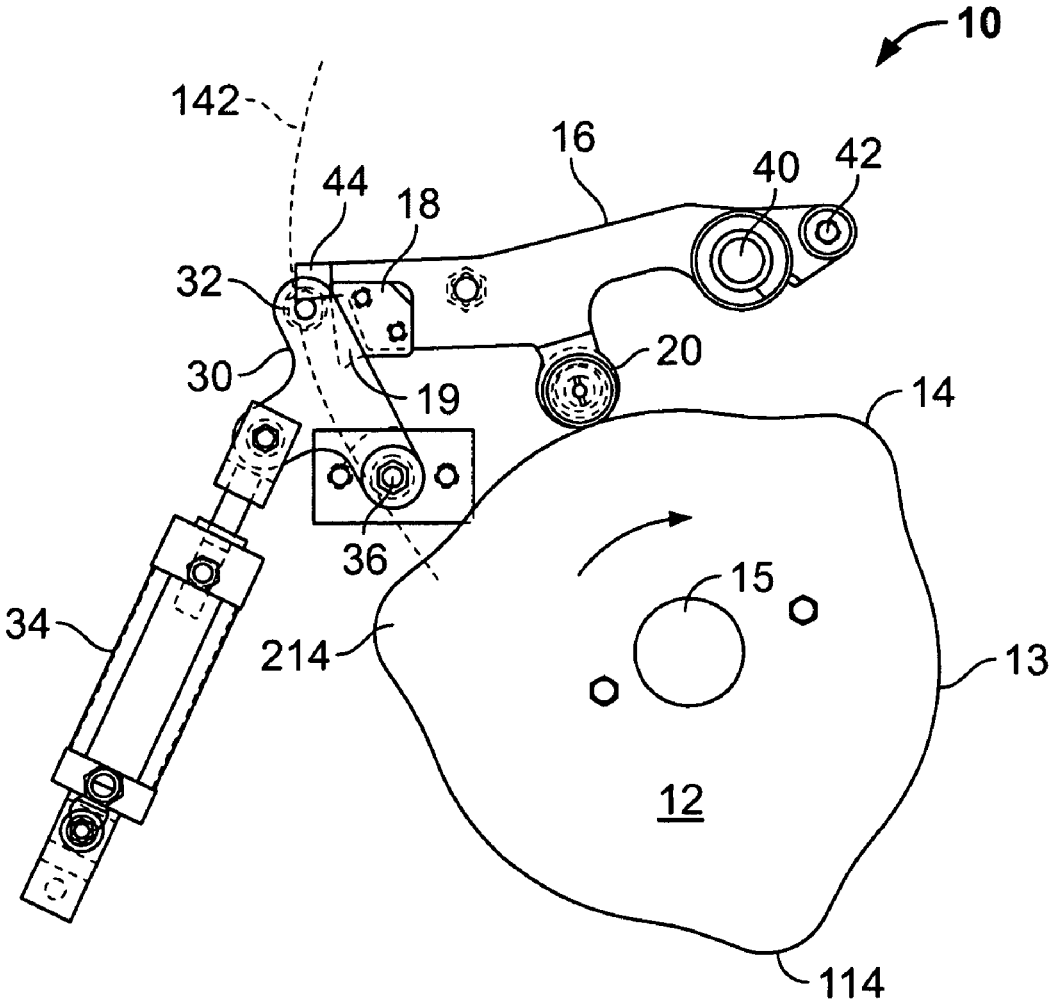
FIG. 1 shows a cam inhibit mechanism according to the present invention.

FIG. 1 shows a cam inhibit mechanism 10 for a sheet material feeder, such as one as disclosed in incorporated by reference U.S. Pat. No. 3,953,018, having a cam 12, cam follower 20, cam follower lever 16 and latch lever 30. Cam 12 includes cam surface 13 with a geometry providing cam high dwells 14, 114, 214. Cam 12 rotates about an-axis 15 and is for example driven by the same shaft as a hopper drum of the sheet material feeder. The cam follower lever 16 pivots about a pivot 42 so that an end 44 defines an arc path 142. Lever 16 can support a sucker bar for example via sucker support 40.

Cam follower lever 16 includes a strike plate 18 on one end opposite pivot 42. Strike plate 18 has a curved surface 29 (FIG. 2), concentric with the arc path 142 of cam follower lever 16, and a lip 19 along a bottom surface.

Latch lever 30 is pivotable about a pivot 36 and includes a roller 32. Pivot 36 advantageously is within the arc path 142 of the cam follower lever 16. An actuator 34 is pivotally connected to latch lever 30.

When actuator 34, such as an air cylinder, does not actuate cam inhibit mechanism 10, roller 32 is situated apart from but close to the curved surface 29 of the strike plate 18 and an end 44 of the cam follower lever 16. Roller 32 could also roll up and down on surface 29 as the cam 12 rotates.

Figure 2:
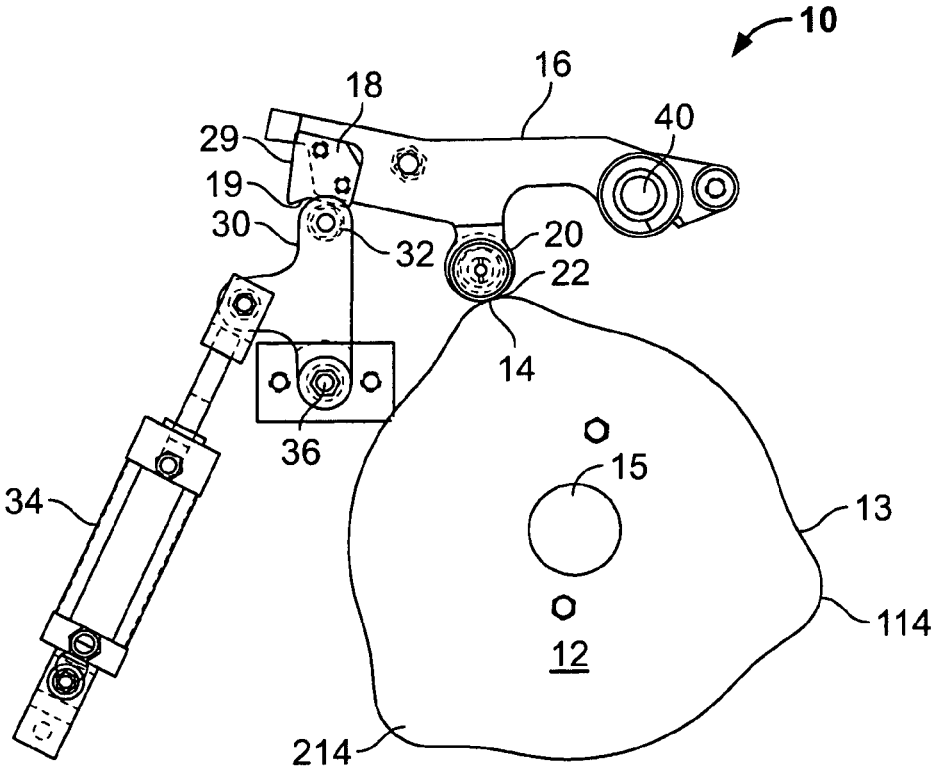
FIG. 2 shows the cam inhibit mechanism in the inhibit position.

If actuator 34 is actuated, latch lever 30 moves a minimal distance and forces the roller against the strike plate 18, so that as one of the high dwells 14, 114, 214 contacts cam follower 20, lever 16 moves upwardly via this cam action and actuator 34 causes roller 32 to slip under lip 19 into the position in FIG. 2.

FIG. 2 shows cam inhibit mechanism 10 in the inhibit position. The roller 32 lifts lever 16 lifts high enough so that a clearance space 22 is formed between the cam follower 20 and the high dwells 14, 114, 214.

Figure 3:
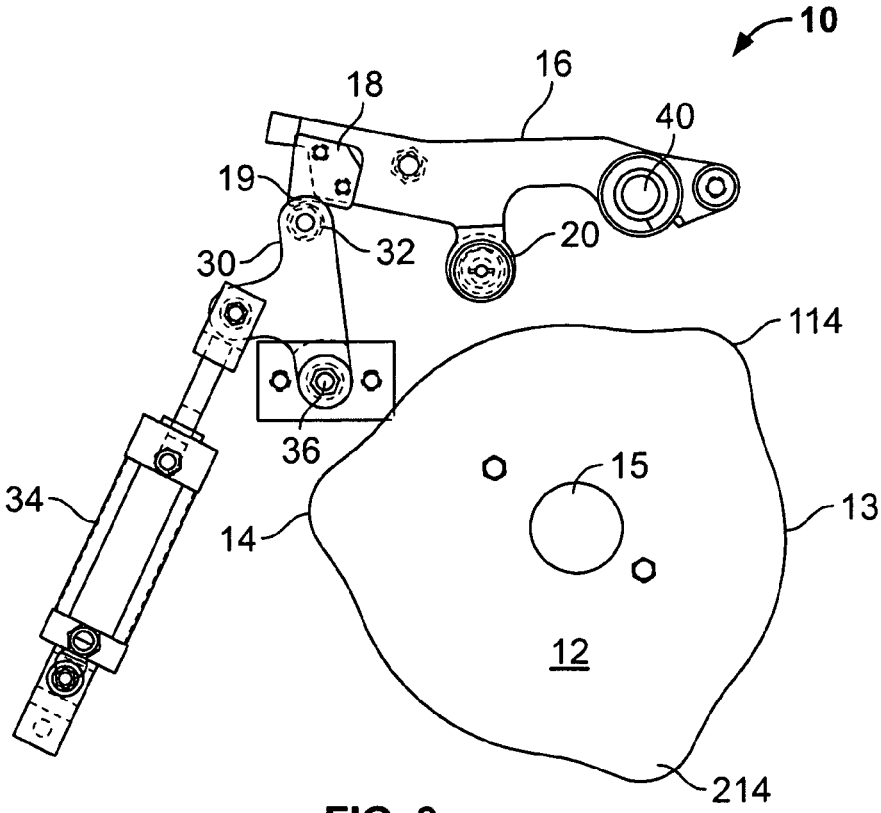
FIG. 3 shows the cam inhibit mechanism after an actuation device is released.

FIG. 3 shows cam inhibit mechanism 10 in the latched position after the actuation device is released and the inhibit function is to be turned off. The actuator 34 releases and roller 32 rolls back across strike plate 18 until stop lip 19 catches roller 32. The cam inhibit mechanism 10 remains in this position until high dwell 14 hits cam follower 20, which causes cam follower arm 16 to rise so that stop lip 19 no longer blocks roller 32, which then can pass back into the position of FIG. 1.

In addition, to sheet material feeders, the present invention can be used in other devices, including tuckers or jaws for folders or other printed material devices requiring an inhibit function. A collating apparatus such as an inserter or saddle stitcher may have the sheet material feeders of the present invention.

What is claimed is:

1. A printed product processing device with an inhibit function for a movable component comprising:

a rotating cam;

a cam follower actuating the movable component;

a cam follower lever supporting the cam follower, the cam follower lever including a strike plate having an outer surface concentric with an arc path of the cam follower lever; and an actuatable latch lever having a roller for rolling on the cam follower lever, the latch lever capable of inhibiting the cam follower from contacting the cam.

2. The printed product processing device as recited in claim 1 wherein the cam follower lever includes a lip for stopping the roller.

3. The printed product processing device as recited in claim 1 further comprising an actuator rotatably connected to the latch lever.

4. The printed product processing device as recited in claim 1 wherein the device is a sheet material feeder.

5. A collating device comprising the printed product processing device as recited in claim 1.

6. A printed product processing device with an inhibit function for a movable component comprising:

a rotating cam;

a cam follower actuating the movable component;

a cam follower lever supporting the cam follower, movement of an end of the cam follower lever defining an arc path; and an actuatable latch lever having a roller for rolling on the cam follower lever, the latch lever capable of inhibiting the cam follower from contacting the cam, the latch lever having a pivot point within the arc path.

7. The printed product processing device as recited in claim 6 wherein the cam follower lever includes a lip for stopping the roller.

8. The printed product processing device as recited in claim 6 further comprising an actuator rotatably connected to the latch lever.

9. The printed product processing device as recited in claim 6 wherein the device is a sheet material feeder.

10. A collating device comprising the printed product processing device as recited in claim 6.

11. A printed product processing device with an inhibit function for a movable component comprising:

a rotating cam;

a cam follower actuating the movable component;

a cam follower lever supporting the cam follower;

a sucker bar support connected to the cam follower lever; and an actuatable latch lever having a roller for rolling on the cam follower lever, the latch lever capable of inhibiting the cam follower from contacting the cam.

12. The printed product processing device as recited in claim 11 wherein the cam follower lever includes a lip for stopping the roller.

13. The printed product processing device as recited in claim 11 further comprising an actuator rotatably connected to the latch lever.

14. The printed product processing device as recited in claim 11 wherein the device is a sheet material feeder.

15. A collating device comprising the printed product processing device as recited in claim 11.

16. A printed product processing device with an inhibit function for a movable component comprising:

a rotating cam;

a cam follower actuating the movable component;

a cam follower lever supporting the cam follower; and an actuatable latch lever, the latch lever having a latch lever pivot point located within an arc path of the cam follower lever, the latch lever capable of inhibiting the cam follower from contacting the cam.

17. The printed product processing device as recited in claim 16 wherein the cam follower lever includes a lip for stopping the roller.

18. The printed product processing device as recited in claim 16 further comprising an actuator rotatably connected to the latch lever.

19. The printed product processing device as recited in claim 16 wherein the device is a sheet material feeder.

20. A collating device comprising the printed product processing device as recited in claim 16.

21. A method for inhibiting a cam follower from following a cam comprising the steps of:

permitting a cam follower to follow a cam with at least one high dwell;

moving the cam follower out of the path of the at least one high dwell by pushing up a cam follower lever of the cam follower using a roller;

permitting the roller to rest against a lip of the cam follower lever; and rotating the cam so that the at least one high dwell contacts the roller and releases the roller from the lip.

* * * * *